United States Patent [19]

Cade

[11] Patent Number: 4,482,312

[45] Date of Patent: Nov. 13, 1984

[54] BURNER CONTROL SYSTEM

[75] Inventor: Phillip J. Cade, Winchester, Mass.

[73] Assignee: Electronics Corporation of America, Cambridge, Mass.

[21] Appl. No.: 50,480

[22] Filed: Jun. 20, 1979

[51] Int. Cl.[3] ..... F23N 5/00

[52] U.S. Cl. ..... 431/31; 431/63; 431/46; 431/26

[58] Field of Search ..... 431/24–26, 431/31, 46, 62, 63

[56] References Cited

U.S. PATENT DOCUMENTS

| | | | |
|---|---|---|---|
| 2,616,490 | 12/1952 | Wilson et al. | 431/24 |
| 3,221,799 | 12/1965 | Hamelink et al. | 431/62 |
| 3,358,735 | 12/1967 | Luft | 431/62 |
| 3,672,811 | 6/1972 | Hron | 431/31 |
| 3,814,569 | 6/1974 | Jacobsz | 431/26 |
| 3,840,322 | 10/1974 | Cade | 431/78 |
| 4,101,258 | 7/1978 | Jacobsz | 431/31 |

*Primary Examiner*—Carroll B. Dority, Jr.
*Attorney, Agent, or Firm*—Charles E. Pfund

[57] ABSTRACT

A burner control apparatus for use with a furnace installation that has an operating control to produce a request for burner operation, a flame sensor to produce a signal when flame is present in the monitored combustion chamber, one or more devices for control of ignition and relay fuel flow, and a modulator controlling air and fuel flow to a main burner for varying heat output. The burner control apparatus comprises a lockout relay for shutting down the furnace, a control device for actuating the ignition and fuel control devices, and a timing circuit that provides several successive and partially overlapping timing intervals of precise relation, including a purge interval, a pilot ignition interval, and a main fuel ignition interval. The present invention includes circuitry for providing a purge interval with the modulator at a high air flow setting. After the purge interval, pilot flame ignition is prevented until the modulator has been moved to a low fire position. The present invention further includes a burner control system which verifies the proper operation of certain sensors in a burner or furnace including particularly a fuel valve end switch, an air flow switch, and modulator position switches.

15 Claims, 5 Drawing Figures

BURNER CONTROL SYSTEM

FIELD OF THE INVENTION

This invention relates to electrical control circuits and more particularly to electrical control circuits adapted for use in burner control systems.

BACKGROUND OF THE INVENTION

Burner control systems are designed both to monitor the existence of flame in a supervised combustion chamber and to time and verify a sequence of operations of burner controls and safety interlocks. The safety of the burner operation is a prime consideration in the design of burner control systems. For example, if fuel is introduced into the combustion chamber and ignition does not take place within a reasonable time, an explosive concentration of fuel may accumulate. A burner control system should reliably monitor the existence of flame in the combustion chamber, accurately time a trial-for-ignition interval, inhibit ignition if a false flame signal is present, and shut down the burner in a safe condition whenever a potentially dangerous condition exists. Examples of such burner control systems are shown in U.S. Pat. Nos. 3,840,322 and 4,137,035, and U.S. Pat. Application Ser. No. 9,307 filed on Feb. 5, 1979 by Phillip J. Cade, now U.S. Pat. No. 4,243,372.

In certain furnace systems, the amount of heat provided by the furnace may be continuously varied by means of a modulator which controls the amount of air flowing through the furnace and the amount of fuel which is provided to the furnace burner. Typically, such a modulator includes a motor which simultaneously drives a fuel valve and an air valve to provide such control. In starting up such a burner system including a modulator, it is desirous to provide different air and fuel flow settings during different parts of the start-up procedure for reasons of safety and efficiency. As part of this start-up procedure, certain interlocks should also be checked to determine that the furnace is in a safe condition to begin operation.

SUMMARY OF THE INVENTION

The present invention includes a burner control apparatus for use with a fuel burner installation that has an operating control to produce a request for burner operation, a flame sensor to produce a signal when flame is present in the monitored combustion chamber, a modulator which controls air and fuel flow to a main burner for varying heat output, and one or more devices for control of ignition and fuel flow. The control circuitry times several successive timing intervals during the start-up procedure of the furnace. The control system includes circuitry for providing an initial purge period at a high air flow setting of the modulator and for reducing the modulator setting to a low fire position before ignition of a pilot flame is attempted. The prior art provides such "high fire" and "low fire" control in response to switch actuation as shown, for example, in U.S. Pat. Nos:

3,109,480
3,164,201
3,732,057
3,814,569
3,887,325

In an illustrated embodiment of the present invention, a single capacitor is used to provide the purge timing intervals. Following successful completion of the purge interval, a pilot flame is established which in turn ignites a main flame. If flame has not been established in the furnace by a predetermined time, the burner control system shuts down the furnace.

The present invention further includes a burner control system which verifies the proper position of certain sensors in a furnace during the start-up procedure, including a fuel valve end switch and an air flow sensor. A preferred embodiment of the present invention is disclosed in which the above-described features are implemented by means of solid state circuitry which is compact and reliable and which provides the desired operating characteristics.

DESCRIPTION OF THE DRAWINGS

The operation and advantages of the present invention will become more clear upon reading the following description of the preferred embodiment in conjunction with the accompanying drawings, of which.

DETAILED DESCRIPTION OF THE PREFERRED EMBODIMENT

Figure 1:
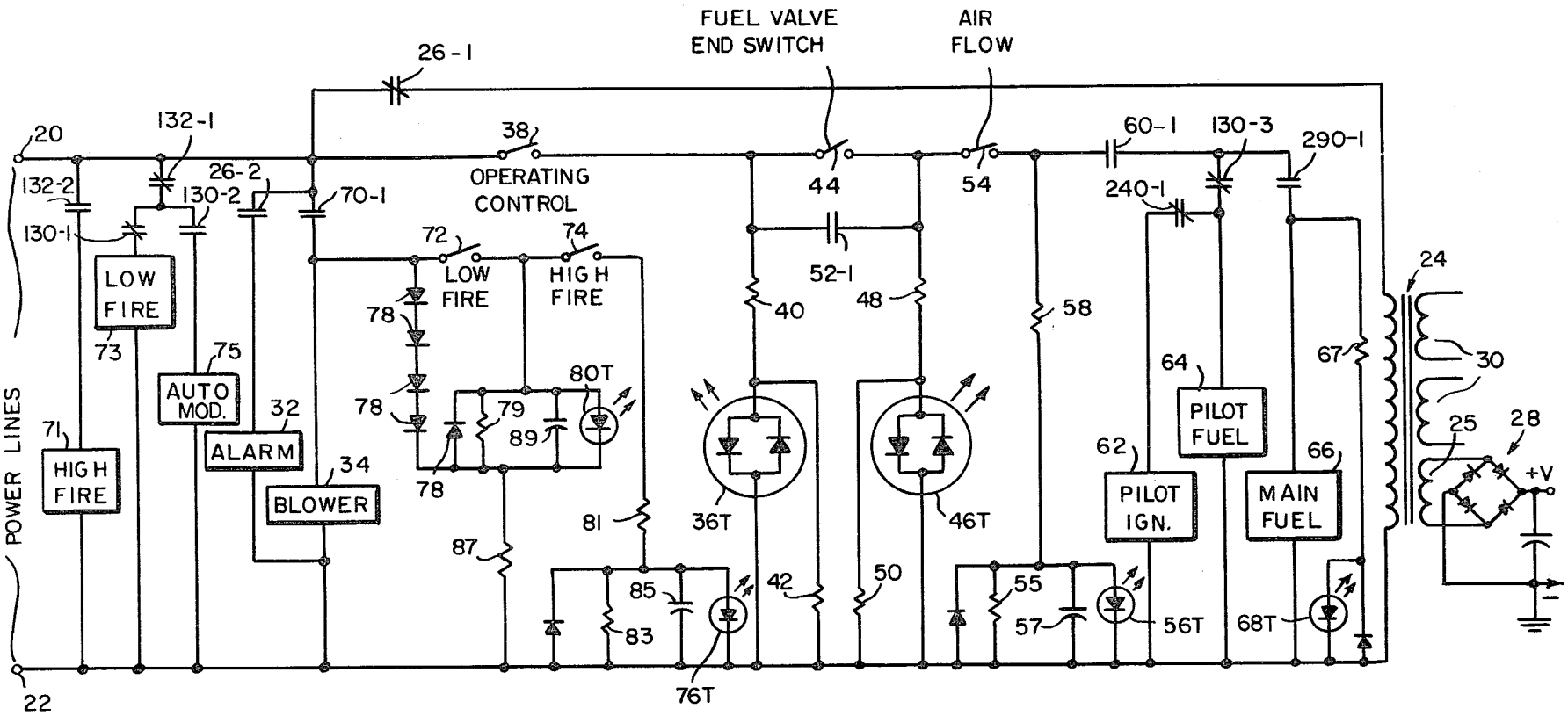
FIGS. 1, 2, and 3 are detailed skematic diagrams of one embodiment of the present invention.
Figure 1A:
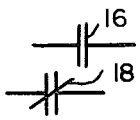
FIG. 1A illustrates the meaning of certain symbols used in FIG. 1.

Referring briefly to FIG. 1A, certain symbols used in FIG. 1 are illustrated. The symbol 16 illustrates a set of relay contacts which are normally open when the associated relay is in a non-actuated condition, i.e., when no current is flowing through the relay coil. Contacts 18 denote relay contacts which are normally closed when the relay is a non-actuated condition.

Referring to FIG. 1, that portion of the burner control circuitry which is attached directly to the power line is shown. This circuitry operates in conjunction with and is responsive to the low voltage control circuitry shown in FIGS. 2 and 3, and described below.

An AC power line signal is applied to hot terminal 20 and neutral terminal 22. In the described embodiment, the power line signal is a 120 volt 60 Hertz signal. Common terminal 22 is connected directly to the primary winding of a transformer 24, and hot terminal 20 is connected to the primary winding via the contacts 26-1 of a lockout relay 26 FIG. 3. Contacts 26-1 are normally closed and open in response to actuation of the lockout relay 26, which is included in the low voltage control circuitry described below. Transformer 24 includes a low voltage secondary 25 which provides a signal which is rectified and filtered by power supply circuitry 28 to provide DC voltage for powering the low voltage control circuitry. Transformer 24 also typically has additional secondary windings 30 for powering other parts of the burner system, such as a high voltage secondary for powering an ultraviolet scanner tube.

Normally, lockout contacts 26-1 are closed and power is provided to transformer 24. If a dangerous condition is detected by the burner control circuitry, lockout contacts 26-1 open and power is removed from transformer 24. Lockout relay 26 also has a normally open set of contacts 26-2 which are connected in series with an alarm 32 across the power line; and when the lockout relay 26 is actuated, contacts 26-2 close to sound an alarm.

A photo-transmitter 36T of an optical coupler circuit is connected across the AC power line in series with an operating control switch 38. A current limiting resistor 40 is connected in series with photo-transmitter 36T, and a shunt resistor 42 is connected across transmitter 36T. When operating control 38 closes, power is applied to the photo-transmitter 36T of the optical coupler, and in response, the photo-receiver 36R FIG. 2 of the optical coupler changes resistance to provide a signal indicating that the operating control 38 is closed.

Figure 2:
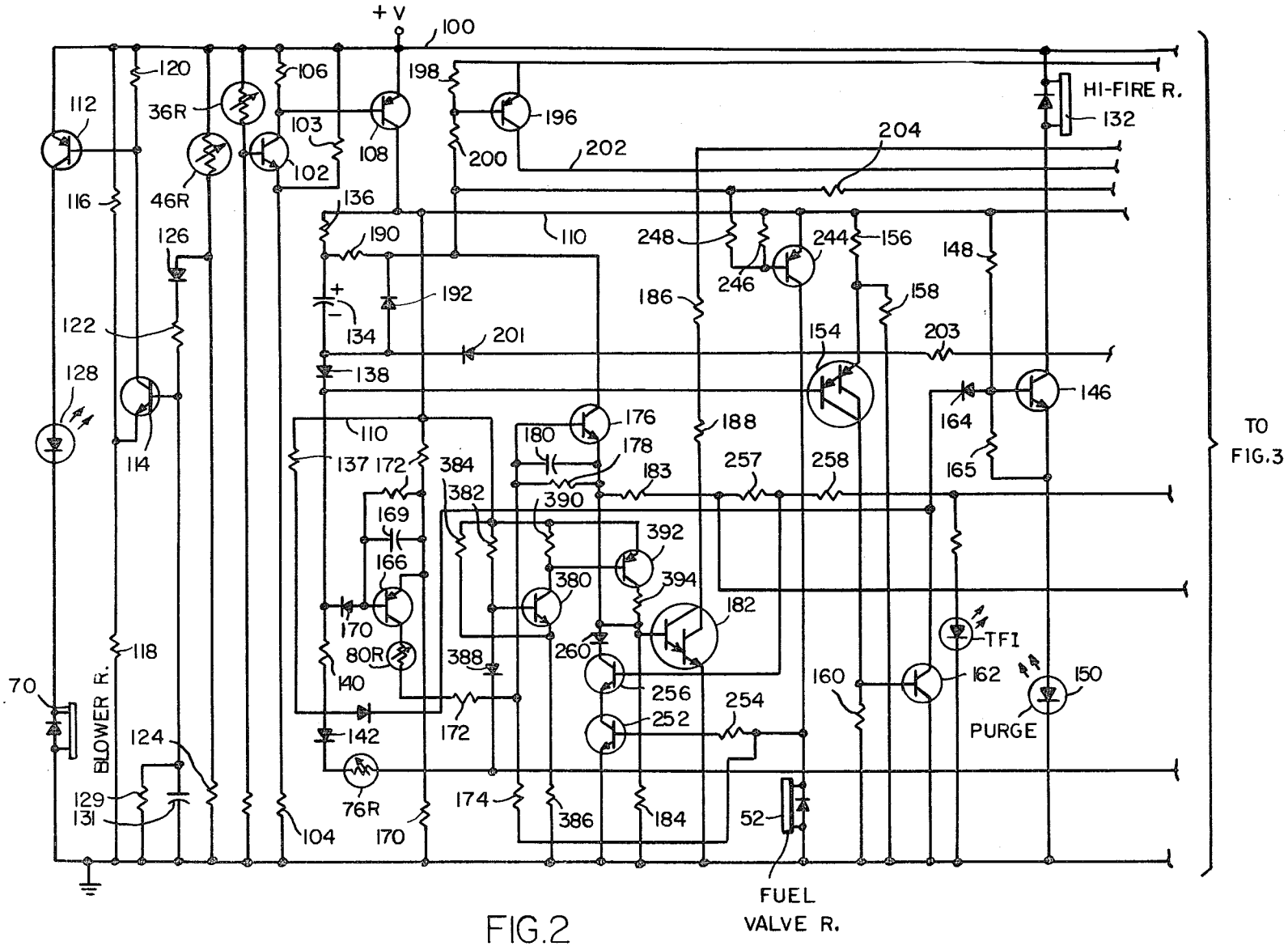

A fuel valve end switch 44 is connected across the power line in series with operating control 38 and a second optical coupler photo-transmitter 46T. Fuel valve end switch 44 is closed when the burner fuel valve is completely shut off. When operating control 38 is closed, optical coupler 46T provides a signal indicating that the fuel valve end switch is closed when switch 44 is closed. The closing of fuel valve end switch 44 also applies AC power to the following circuitry described below. Normally-open contacts 52-1 of a fuel valve relay 52, FIG. 2, are connected across fuel valve end switch 44. After an initial purge interval, the fuel valve is opened to provide fuel to the pilot and main burners of the furnace, and fuel valve end switch 44 opens. The fuel valve relay 52 is actuated at this time, and contacts 52-1 close to maintain AC power to the following circuitry after switch 44 opens.

An air flow switch 54 is connected in series with operating control 38 and fuel valve end switch 44 to provide a signal to a third optical coupler photo-transmitter 56T. Optical coupler 56R, FIG. 3, receives a signal when air flow switch 54 closes, indicating that a sufficient air flow is flowing through the burner. A resistor 58 in series with photo-transmitter 56T limits the current flowing through photo-transmitter 56T.

Figure 3:
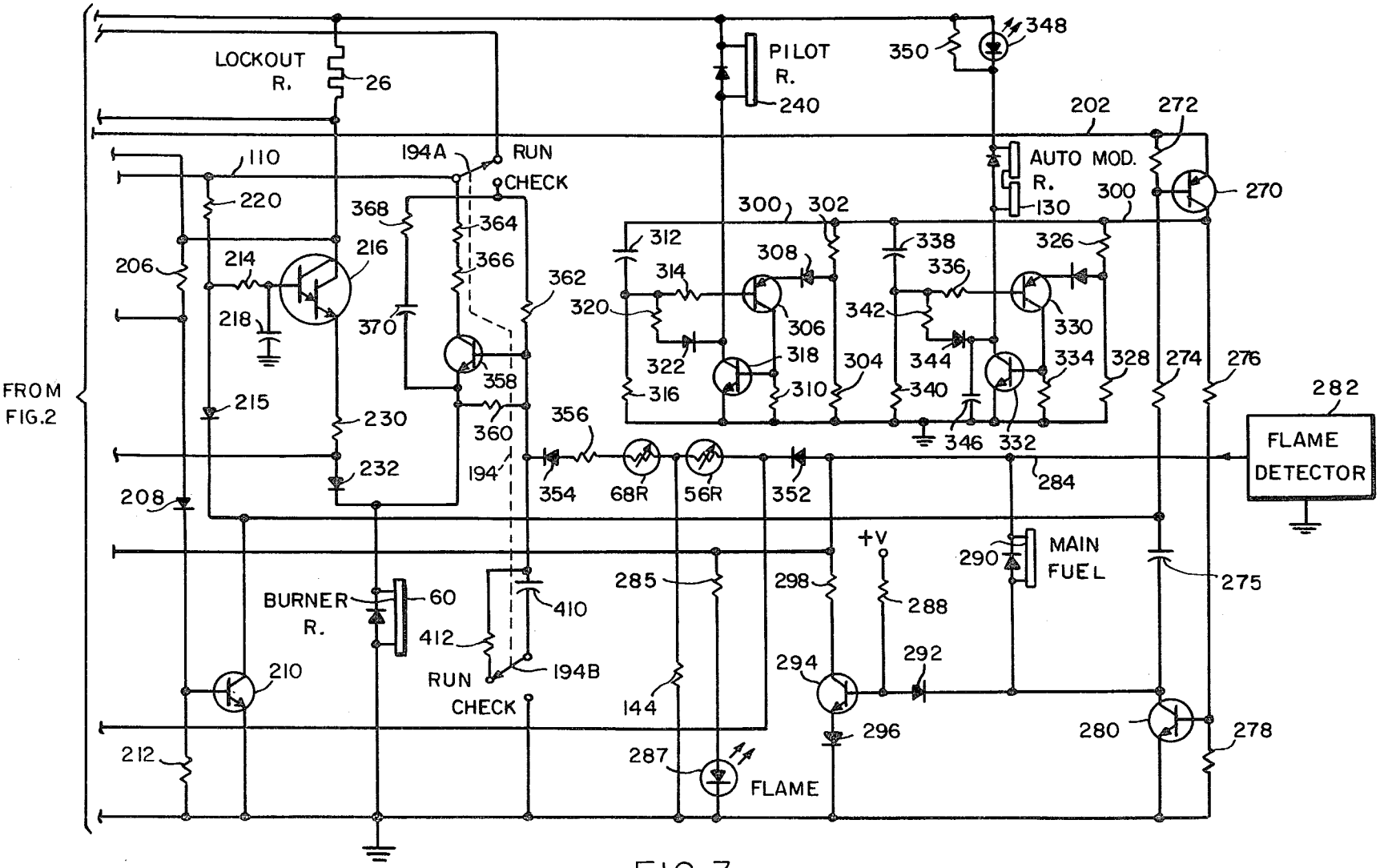

A set of relay contacts 60-1 of a burner relay 60, FIG. 3, are connected in series with operating control 38, fuel valve end switch 44, and air flow switch 54 across the AC power line. When the burner control circuitry has completed the purge interval and determined that it is safe to proceed with pilot and main burner ignition, contacts 60-1 are closed, applying power to the following circuitry. This circuitry includes a pilot burner ignition source 62, a pilot fuel valve 64, and a main fuel valve 66. Several sets of relay contacts are in series with the ignition source and fuel valves and are actuated to provide the proper burner start-up sequence, as described in detail below. In parallel with the main fuel valve 66 is a current limiting resistor 67 and a photo-transmitter 68T of an optical coupler which provides a signal photo-receiver 68R and thus to the control circuitry indicating a main fuel valve is open as will be described.

The present invention is designed for use with a furnace system which has a variable air flow. Typically, the air flow rate is varied by circuitry not described herein to provide a continuous control over the heat output of the furnace. The air flow is controlled by a modulator, not shown, which includes a low fire switch 72 which is closed when the modulator is at a predetermined low air flow position and a high fire switch 74 which is closed when the modulator is at a predetermined high air flow position. Air flow is provided through the furnace by means of a blower 34 which is connected across the power line in series with contacts 70-1 of a blower relay 70. Switches 72 and 74 are also connected across the power line in series with blower relay contacts 70-1 so that no power is applied to these switches until the blower motor is turned on by the burner control circuitry.

Associated with low fire switch 72 and high fire switch 74 is circuitry which provides an indication when one of these switches is closed. High fire switch 74 is connected in series with an optical coupler transmitter 76T across the power line. When high fire switch 74 is closed, low fire switch 72 should be open, and fire is provided to high power switch 74 by means of several diodes 78 which are connected in series across the contacts of low fire switch 72 thus energizing optical transmitter 76T. Another optical coupler transmitter 80T is connected between low fire switch 72 and common terminal 22 via resistor 88 to provide an indication when low fire switch 72 is closed (high fire switch 74 open).

Connected across the power line in series with several relay contacts are a high fire actuator 71, a low fire actuator 73, and the modulator automatic circuitry 75. When power is applied to high fire actuator 71, the modulator is moved to the high fire position; and similarly when power is applied to low fire actuator 73, the modulator is moved to the low fire position. In series respectively with the high fire and low fire actuators 71 and 73, are two sets of contacts, 132-1 and 132-2 which are actuated by high fire relay 132 (FIG. 2). Contacts 132-1 are normally closed, and contacts 132-2 are normally open. Thus, the high fire actuator and low fire actuator 73 cannot be simultaneously energized. At the end of the ignition sequence, power is removed from both the high and low fire actuators 71,73 and applied to the automatic modulator control circuit 75 to allow it to control the output of the burners as will be described.

Referring to FIGS. 2 and 3 the low voltage control circuitry of the described embodiment is shown. Power is provided by power supply 28 to power supply bus 100 to provide power to the control circuitry.

Blower relay 70 is connected between power supply bus 100 and ground in series with a transistor 112 and LED 128. Transistor 112 is turned on and off by a second transistor 114. The emitter of transistor 114 is biased at approximately one-third the power supply voltage by resistors 116 and 118. The base of the transistor 114 is connected to ground through resistors 122 and 124 and a diode 126 and the parallel RC circuit 129,131. Optical coupler receiver 46R is connected between power supply bus 100 and the base of transistor 114 via resistor 122 and diode 126. When receiver 46R is not illuminated, the base of transistor 114 is clamped to ground. When operating control 38 is closed, if fuel valve end switch 44 is closed, power is applied to transmitter 46T and the resistance of receiver 46R decreases. The current flowing through the low resistance of receiver 46R provides base current to transistor 114 turning on transistor 114. This, in turn, turns on transistor 112 actuating relay 70 and turning on blower 34. An LED 128 in series with relay 70 is illuminated by the current flowing through relay 70 to provide an indication that the blower is operating.

If the fuel valve end switch 44 is not closed when operating control 38 is actuated, the blower 34 does not turn on. Power is applied to the low fire actuator 73 via relay contacts 130-1 and 132-1. This causes the modulator to go to the low fire position, and when low fire switch 72 closes, power is applied to blower 34.

A capacitor 131 and a resistor 129 are connected in parallel between the base of transistor 114 and ground. When the operating control 38 is opened, power is removed from optical coupler transmitter 46T, and receiver 46R goes to a high resistance state, forcing the voltage at the junction of receiver 46R and resistor 124 to go to a very low value. Capacitor 131, however, maintains the base terminal at the previous voltage. Diode 126 prevents capacitor 131 from being discharged through resistor 124. Due to the charge on capacitor 131, transistors 114 and 112 stay on, and the blower 34 continues to run until capacitor 131 is discharged by resistor 129 and the base current of transistor 114. This provides a post-operation purge period, which is typically approximately 20 to 30 seconds long.

When operating control 38 is closed, power is applied to optical coupler transmitter 36T. The optical coupler receiver 36R is connected between power bus 100 and the base of a transistor 102. The emitter of transistor 102 is connected to ground via a resistor 104, and the collector of transistor 102 is connected to power bus 100 via load resistor 106. The collector of transistor 102 is also connected to the base terminal of a transistor 108 which has its emitter connected to power supply bus 100. When operating control 38 is closed illuminating optical coupler transmitter 36T, the resistance of receiver 36R decreases. The resulting base current turns on transistor 102 which turns on transistor 108. The collector of transistor 108 is connected to a line 110, thus has power applied thereto whenever operating control 38 is closed.

A capacitor 134 is connected to line 110 by a resistor 136 and times several intervals at the beginning of the burner start-up sequence. The positive terminal of capacitor 134 is connected to bus 110 via a resistor 136. The negative terminal of capacitor 134 is connected to ground via diode 138, resistor 140, diode 142, optical coupler receivers 76R and 56R, and resistor 144. When power is applied to bus 110, the positive terminal of capacitor 134 goes to a voltage approximately equal to the power supply voltage. As described above, optical coupler receiver 76R is illuminated only when high fire switch 74 is closed. Similarly, optical coupler 56R is illuminated only when air flow switch 54 is closed. Thus, timing of the purge interval, which is controlled by the charging of capacitor 134 does not begin until both high fire switch 74 and air flow switch 54 are closed. Capacitor 134 then starts to charge through the above-described charging path to ground. Resistor 140 is much larger than the resistances of the other elements in the charging path, and resistor 140 in conjunction with capacitor 134 determines the charging time constant. Typically, capacitor 134 is a polarized capacitor, and a diode 192 is connected in series with a resistor 190 across capacitor 134 to prevent a voltage of the wrong polarity from being applied to capacitor 134.

High fire relay 132 is connected between the power supply bus 100 and the collector of a transistor 146. Transistor 146 has its base terminal connected to line 110 via a resistor 148, and thus transistor 146 turns on as soon as power is applied to bus 110. This causes current to flow through high fire relay 132, opening contacts 132-1 and closing contacts 132-2. (See FIG. 1.) Power is applied to high fire actuator 71, which causes the modulator to go to the high fire position, if it is not already there. An indicator 150, such as an LED, is connected between the emitter of transistor 146 and ground and provides an indication of conduction in transistor 146 when the burner control is in the purge interval of a start-up procedure. At the end of the purge interval, transistor 146 is turned off, as described below, and purge indicator 150 turns off.

Once high fire switch 74 and air flow switch 54 are closed, capacitor 134 begins charging as described above. The purge interval is divided into two parts. The start-up sequence begins with the furnace first being purged at a high air flow to clear out any fumes or fuel vapors which may remain in the furnace. Typically, this period lasts for approximately 30 seconds. Following the high air flow purge, the modulator is moved to the low fire and low air flow position in preparation for igniting the pilot burner as will now be described.

A Darlington transistor 154 has its emitter connected to a voltage divider made up of resistors 156 and 158. Resistors 156 and 158 maintain the emitter of transistor 154 at a voltage approximately two-thirds of the power supply voltage. The base terminal of transistor 154 is connected via a diode 138 to the negative terminal of capacitor 134. At the beginning of the purge interval, the voltage across capacitor 134 is zero or nearly so, keeping the base terminal of transistor 154 positive with respect to the emitter. When capacitor 134 has charged sufficiently, the base terminal of transistor 154 becomes more negative than the emitter terminal, and transistor 154 turns on.

The collector terminal of transistor 154 is connected to ground via a load resistor 160 and also to the base terminal of a transistor 162. The emitter of transistor 162 is connected to ground, and the collector of transistor 162 is connected by diode 164 to the base terminal of transistor 146 which controls high fire relay 132. When transistor 162 turns on, the base terminal of transistor 146 is clamped to ground and transistor 146 turns off, causing the high fire relay 132 to drop out. This opens contacts 132-2 and closes contacts 132-1, applying power to low fire actuator 73 and moving the modulator from the high fire position to the low fire position.

After the purge interval has ended capacitor 134 continues to charge. A second transistor 166 has its emitter biased at a voltage approximately 40% of the power supply voltage by a voltage divider made up of resistors 168 and 170. A resistor 172 and capacitor 169 are connected between the base and emitter terminals of transistor 166, and the base terminal is connected to the negative terminal of capacitor 134 by diodes 170 and 138. Transistor 166 is maintained off by resistor 168 until capacitor 134 charges sufficiently to turn on transistor 166. If low fire switch 72 is not closed when transistor 166 is turned on, the optical coupler receiver 80R in the collector lead of transistor 66 is not illuminated and is in a high resistance state; and the start-up sequence stops at this point to wait until low fire switch 72 closes. The turn on of 166 is delayed following the end of the purge period to allow the modulator to approach the low fire position if low fire switch 72 is jumpered or receiver 80R is shorted. This prevents the furnace from attempting to ignite the pilot flame with the modulator in the high fire position, which could be dangerous.

Once the low fire position is reached and switch 72 closes, current flows in the collector circuit of transistor 166 through receiver 80R, resistors 172 and 174, and the coil of fuel valve relay 52. The junction of resistors 172 and 174 is connected to the base terminal of a transistor 176. When transistor 166 turns on, the voltage applied to the base terminal of transistor 176 rises sufficiently to turn on transistor 176. A resistor 178 and capacitor 180 connected between the emitter and base of transistor 176 maintain transistor 176 off until transistor 166 turns on.

The emitter terminal of transistor 176 is connected to the base of a Darlington transistor 182. The base terminal of Darlington 182 is connected to ground via a resistor 184 and holds Darlington 182 off unless a signal is applied to the base terminal. The emitter terminal of Darlington transistor 182 is connected to ground. When transistor 176 turns on, the emitter current of transistor 176 will flow through the emitter-base junction of Darlington 182, turning on Darlington 182 unless the base is clamped to ground by transistors 252 and 256, as described below. The collector of transistor 182 is connected to the heating element of lockout relay 26 via two resistors, 186 and 188. The other terminal of lockout relay 26 is connected to the power supply bus 100. When transistor 182 is on, current flows through lockout relay 26 heating the lockout relay element.

When transistor 176 turns on, the collector current flows through resistors 136 and 190 resulting in a sudden voltage drop. Resistor 136 is much larger than resistor 190, and the voltage drop across resistor 136 is almost equal to the supply voltage. At this time the voltage on capacitor 134 is about 60 percent of the supply voltage, so that when transistor 176 turns on, the negative terminal of capacitor 134 goes to a large negative voltage. This reverse biases diode 138, disconnecting capacitor 134 from the base of transistor 166 and the associated circuitry.

The negative terminal of capacitor 134 is connected to the junction of a resistor 206 and a diode 208. Resistor 206 and diode 208 are connected in series with the heating element of lockout relay 26 between the power supply bus 100 and the base terminal of a transistor 210. A resistor 212 is connected between the base of transistor 210 and ground.

Normally transistor 210 is held on by current flowing through the lockout relay heating element 26, resistor 206, and diode 208 into the base terminal of transistor 210. When transistor 176 turns on, the negative terminal of capacitor 134 drops to a negative voltage with respect to ground. Current flows through resistors 206 and 203 and diode 201 to the negative terminal of capacitor 134. Resistor 206 is much larger than resistor 203, and the voltage of the junction of resistors 206 and 203 goes to a value which is negative with respect to ground. This reverse biases diode 208, and the base of transistor 210 is clamped to ground by resistor 212 turning off transistor 210. The current flowing through resistors 206 and 203 discharges capacitor 134, and the voltage at the negative terminal of capacitor 134 rises. As capacitor 134 discharges, the voltage at the junction of resistor 206 and diode 208 rises. When this voltage exceeds approximately 1.4 volts, transistor 210 turns on. The discharge of capacitor 134 in this manner provides a third timing interval, which is described in more detail below.

The collector terminal of transistor 210 is connected via a diode 215 and a resistor 214 to the base terminal of a second Darlington transistor 216. When transistor 210 is on, the base of transistor 216 is clamped to ground, maintaining transistor 216 in an off condition. When transistor 210 is turned off, current is supplied from bus 110 through resistors 220 and 214 to the base terminal of transistor 216, turning on transistor 216. The collector of transistor 216 is connected to the heating element of lockout relay 26, and when transistor 216 is on the lockout relay 26 is heated. When transistor 216 is on, current flows through emitter resistor 230, diode 232, and the coil of burner relay 60, actuating the burner relay and closing contacts 60-1 in the circuitry shown in FIG. 1.

A switch 194, having two sections 194A and 194B, selects run or check mode for the burner control system. These modes are further described below. Normally (in RUN mode), switch section 194A connects the emitter of a transistor 196 to line 110 which is at the supply voltage. The emitter and base terminals of transistor 196 are connected by a resistor 198, and the base terminal is connected to the collector terminal of transistor 176 by a resistor 200. When transistor 176 turns on, current flows through resistors 198 and 200. The voltage drop across resistor 198 turns on transistor 196, connecting line 202 to the supply voltage. Line 202 applies power to circuitry described below.

A transistor 244 has its emitter connected to line 110 and its base connected to line 110 via a resistor 246. The base of transistor 244 is connected to the collector of transistor 176 via a resistor 248. Transistor 244 is held off by resistor 246 connected from its base to line 110 until transistor 176 turns on. When transistor 176 turns on, current flows through resistors 246 and 248, and transistor 244 turns on. The coil of fuel valve relay 52 is connected between the collector of transistor 244 and ground. When transistor 244 turns on, relay 52 is energized closing contacts 52-1 in parallel with fuel valve end switch 44, shown in FIG. 1. This provides an alternate path for the power line signal when fuel valve end switch 44 subsequently opens during the ignition cycle.

The collector of transistor 244 is also connected to the base of a transistor 252 by a resistor 254. The emitter of transistor 252 is connected to ground, and the collector is connected to the emitter of a second transistor 256. When transistor 244 turns on, the signal applied to the base of transistor 252 via resistor 254 turns on transistor 252 and enables transistor 256. The base of transistor 256 is connected between resistor 230 and diode 232 in the emitter circuit of Darlington transistor 216 by a resistor 258. When Darlington transistor 216 turns on, the voltage drop across the coil of burner relay 60 and diode 232 turns on transistor 256.

The collector of transistor 256 is connected to the base of Darlington transistor 182 by a diode 260. When transistors 252 and 256 are both on, the base of transistor 182 is clamped to ground turning off transistor 182. At this point, the current through the heating element of lockout relay 26 flows entirely through Darlington transistor 216.

When transistor 196 turns on, as described above, the power supply voltage is applied to line 202. A transistor 270 has its emitter terminal connected to line 202 and its base terminal connected to line 202 by a resistor 272. The base terminal of transistor 270 is also connected to the collector of transistor 210 by a resistor 274. When power is applied to line 202, transistor 210 is off, and the base of transistor 270 is clamped to ground keeping transistor 270 off also. When transistor 210 turns on, base current flows through resistor 274, turning on transistor 270.

Two series connected resistors, 276 and 278, connect the collector of transistor 270 to ground. A transistor 280 has its emitter connected to ground and its base connected to the junction of resistors 276 and 278; and when transistor 270 turns on, transistor 280 also turns on. A flame detector 282 provides a high output signal on line 284 to indicate the presence of a main fuel in the furnace burner. The coil of a main fuel relay 290 is connected between line 284 and the collector terminal of transistor 280. As long as transistors 270 and 280 are off, the main fuel relay 290 cannot be actuated. When transistor 280 turns on, the coil of relay 290 is connected to ground and the main fuel relay is enabled. Once the main fuel relay 290 is enabled, the presence of a flame signal on line 284 causes the main fuel relay to be actuated.

The collector of transistor 280 is also connected via a diode 292 to the base terminal of a transistor 294. The emitter of transistor 294 is connected to ground via a diode 296, and the base of transistor 294 is connected to the supply voltage via a resistor 288. The collector of transistor 294 is connected to flame line 284 via a resistor 298. The resistance of resistor 298 is approximately the same as the resistance of the coil of main fuel relay 290. Transistor 294 ensures that the flame detector 282 is provided with a constant load impedance. Before transistor 280 turns on, main fuel relay 290 is disconnected from ground, and the impedance seen by flame detector 282 consists primarily of resistor 298. When transistor 280 turns on connecting main fuel relay 290 to ground, it also clamps the base terminal of transistor 294 to ground, turning off transistor 294.

When transistor 270 turns on, it also applies the supply voltage to a line 300 which powers circuitry for timing the pilot ignition and pilot stabilization intervals. A voltage divider made up of resistors 302 and 304 is connected between line 300 and ground. The emitter of a transistor 306 is connected to the junction of resistors 302 and 304 by a diode 308. A resistor 310 connects the collector of transistor 306 to ground. A capacitor 312 and series connected resistor 314 connect the base of transistor 306 to line 300, and a resistor 316 connects one terminal of capacitor 312 to ground. When power is applied to line 300, capacitor 312 is initially discharged and holds the base of transistor 306 at the supply voltage. After power is applied to line 300, current through resistor 316 charges up capacitor 312 until the base of transistor 306 goes sufficiently negative to turn on transistor 306. The delay time before transistor 306 turns on is determined by the RC time constant of capacitor 312 and resistor 316. A transistor 318 has its base connected to the collector of transistor 306. The emitter of transistor 318 is connected to the power supply bus 100 through the pilot ignition relay 40. When transistor 318 turns on, pilot ignition relay 240 is actuated opening contacts 240-1 and removing the power from the pilot burner ignition circuitry 62. Thus, the RC time constant of capacitor 312 and resistor 316 determine the pilot ignition interval. A resistor 320 and diode 322 connected in series between the collector of transistor 318 and capacitor 312, ensure that transistor 306 and 318 remain on until power is removed from line 300.

A second circuit including transistors 330 and 332 provides the timing for the pilot stabilization interval. This circuitry is similar to that associated with transistors 306 and 318 described above. In this circuitry, the emitter of transistor 330 is biased at a voltage determined by the values of resistors 326 and 328. The base of transistor 330 is connected to a time delay circuit including capacitor 338 and a resistor 340. Transistor 330 turns on a predetermined time after voltage is applied to line 300, and this time is determined by the voltage at the emitter of transistor 330 and the RC time constant of capacitor 338 and resistor 340. When transistor 330 turns on, this turns on transistor 332. The collector of transistor 332 is connected to the power supply bus 100 through auto modulator relay 130. When transistor 332 turns on, auto modulator relay 130 is actuated. This opens contacts 130-1 and closes contacts 130-2, removing power from the low fire actuator 73 and applying power to the automatic modulator circuitry 75 which controls the furnace output. The actuation of relay 130 also opens contacts 130-3 which removes power from the pilot fuel valve 64 ending the main burner ignition interval.

An indicator 348 such as an LED is connected in series with modulator relay 130 and is illuminated by the current flowing through relay 130 to provide an indication that the burner system is in automatic mode. A resistor 350 is connected in parallel with LED 348.

When a flame appears in the furnace, flame detector 282 applies a high, flame signal to line 284. This signal actuates main fuel relay 290, closing contacts 290-1 and applying power to the main fuel valve 66. This begins the main burner ignition interval. The flame signal on line 284 is applied via a diode 352, optical coupler receivers 56R and 68R, resistor 356 and diode 354 to the base of a transistor 358. The collector of transistor 358 is connected to line 110 through resistor 364 and 366, and the emitter of transistor 358 is connected to burner relay 60. A resistor 360 connected between the emitter of transistor 358 and ground holds transistor 358 off in the absence of a flame signal on line 284. When a flame signal is provided by flame detector 282, transistor 358 turns on, and provides an alternate path for current through relay 60. This holds burner relay 60 on after transistor 216 is turned off.

Following the closing of operating control 38, lockout heat is provided to lockout relay 26 until power is applied to optical coupler 56. This ensures that the system will lock out if either fuel valve switch 44 or air flow switch 54 do not close. Lockout heat is provided in the following manner.

When line 110 goes high, power is applied to a circuit including two transistors 380 and 392. Transistor 380 has a load resistor 390 connected between its collector and line 110. The emitter of transistor 380 is biased slightly above ground by a voltage divider including resistors 384 and 386 connected between line 110 and ground, and the emitter of transistor 380 is connected to the junction of resistors 384 and 386. A resistor 382 connected between line 110 and the base of transistor 380 holds transistor 380 on unless the base terminal is held low, as described below.

The collector of transistor 380 is connected to the base terminal of transistor 392. The emitter of transistor 392 is connected to line 110 and the collector is connected to the base of Darlington transistor 182 via a resistor 394. If transistor 380 turns on, this turns on transistor 392 which supplies base current to Darlington transistor 182. Darlington transistor 182 then turns on, heating lockout relay 26.

The base of transistor 380 is connected to ground via a diode 388, optical coupler receiver 56R, and resistor 144. When receiver 56R is illuminated and is in a low resistance state, the base of transistor 380 is clamped to ground, and transistor 182 is not turned off. Receiver 56R will be illuminated during the beginning of a cycle only when fuel valve end switch 44 and air flow switch 44 are both closed. If either switch remains open after operating control 38 closes, the system goes to lockout.

Figure 4:
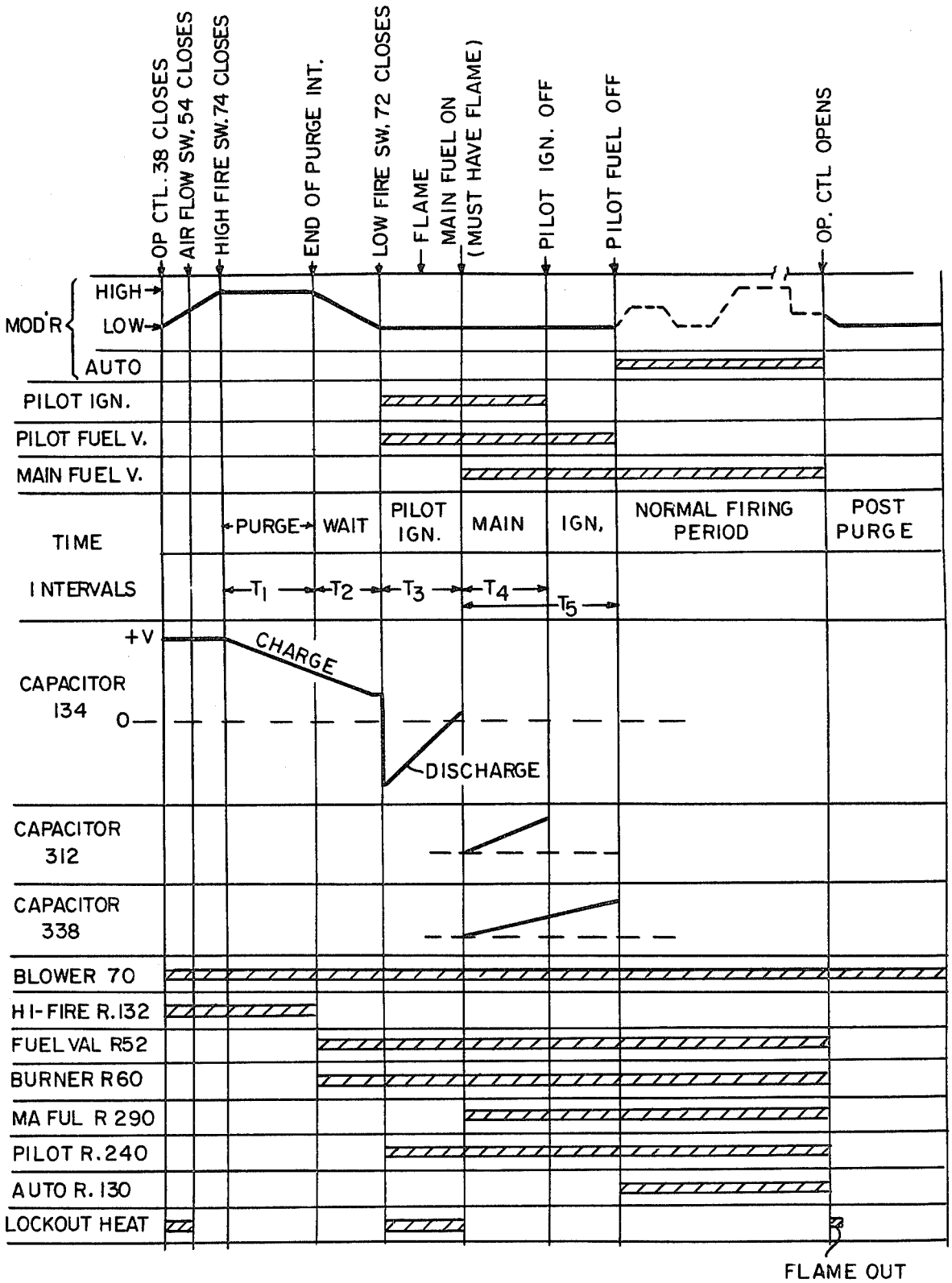
FIG. 4 is a timing diagram which is useful in explaining the operation of the present invention.

Referring to FIG. 4, there is shown a timing chart which shows the times at which various events occur in the operation of the presently described burner control circuitry. The top line in FIG. 4 shows the position of the furnace modulator. The next line shows when the modulator is in automatic mode. The next three lines show when the pilot ignition circuitry 62, the pilot fuel valve 64, and the main fuel valve 66 are actuated. The next line shows the various time intervals which are important in the operation of the present invention. The next three waveforms show the voltages across capacitors 134, 312, and 338 as they charge and discharge to time the different intervals. Following are timing diagrams which show when each of the relays in the burner control circuitry are actuated. Finally, the bottom line shows the periods during which power is applied to heat lockout relay 26.

The operation of the circuitry shown in FIGS. 1, 2, and 3 will now be explained with reference to FIG. 4. Prior to the closing of operation control 38, and assuming that lockout relay 26 has not been actuated, power is present on bus 100. All transistors shown in FIGS. 2 and 3 are off, except for transistor 210 and transistor 294. As described above, transistor 294 is kept on to provide a predetermined impedance to flame detector 282. Transistor 294 is maintained in an on state by bias resistor 288 which is connected between power supply bus 100 (+V) and the base terminal of transistor 294. Bias current for transistor 210 is provided from the power supply bus 100 through lockout relay 26 and resistor 206. Transistor 210 clamps the base of transistor 216 to ground to prevent it from turning on heating the element of lockout relay 26.

To begin operation, operating control 38 closes. This illuminates optical coupler 36T, turning on transistors 102 and 108 and applying power to line 110. When power is applied to line 110, transistor 146 turns on pulling in high fire relay 132. This opens contacts 132-1 and closes contacts 132-2 in FIG. 1, applying power to high fire actuator 71. Generally, the modulator is in the low fire position when the furnace is off; and the modulator now moves from the low fire position to the high fire position, as shown in FIG. 4.

When operating control 38 closes and fuel valve end switch 44 is closed, optical coupler 46T is illuminated and blower relay 70 pulls in, actuating the blower motor. After a sufficient air flow is present in the furnace, air flow switch 54 closes illuminating optical coupler 56T. Following the closing of operating control 38, lockout heat is provided to lockout relay 26 until power is applied to optical coupler 56T, as described above, to ensure that the system will lock out if either fuel valve switch 44 or air flow switch 54 do not close.

The timing intervals $T_1$ through $T_5$ are timed in the following manner. The charging path for capacitor 134 includes diode 134, resistor 140, diode 142, optical couplers 76R and 56R, and resistor 144. After air flow switch 54 closes illuminating optical coupler 56T, capacitor 134 begins to charge as soon as high fire switch 74 is closed illuminating optical coupler 76T. This begins the purge period, during which a high air flow is maintained in the furnace to purge any fumes which may be present. The purge interval is denoted at $T_1$ in FIG. 4 and is determined by the discharge time of capacitor 134 and the voltage at which the emitter of transistor 154 is biased by resistors 156 and 158.

When capacitor 134 discharges sufficiently, transistor 154 turns on, ending the purge period $T_1$. Transistor 154 turns on transistor 162 which clamps the base of transistor 146 to ground, removing current from high fire relay 132 which then drops out. Power is now applied to low fire actuator 73 through relay contacts 130-1 and 132-1; and the furnace modulator moves to the low fire position. This time is designated the wait interval $T_2$ in FIG. 4.

Capacitor 134 continues to discharge until it turns on transistor 166. At this point, capacitor 134 is prevented from discharging below the voltage at the emitter terminal of transistor 166. If low fire switch 72 is not closed, the burner control system now waits until low fire switch 72 closes illuminating optical coupler 80T. When receiver 80R in the collector circuit of transistor 166 is illuminated and goes to a low resistance state, transistor 176 is turned on by transistor 166. This ends the wait interval $T_2$.

Wait interval $T_2$ has a minimum time which is determined by the time required for capacitor 134 to discharge from the point at which transistor 154 turns on to the point at which transistor 166 turns on. If the low fire switch 72 is not closed at this time, the control system will wait until low fire switch 72 does close. The minimum interval provided by the additional discharge time to turn on transistor 166 ensures that a shorted or jumpered low fire switch 72 will not result in pilot ignition being attempted while the furnace modulator is in the high fire position. During the minimum period, the modulator will have closed sufficiently to allow a safe attempt to ignite the pilot.

When transistor 176 turns on the wait interval $T_2$ ends and the pilot ignition interval $T_3$ begins. The turning on of transistor 176 to begin the pilot ignition has the following results. As described above, the positive terminal of capacitor 134 is pulled down almost to ground by transistor 176; and the negative terminal of capacitor 134 undergoes a corresponding step decrease in voltage and goes negative with respect to ground, as shown in FIG. 4. This turns off transistor 210, removing the clamp from the base terminal of Darlington transistor 216. Transistor 216 turns on heating lockout relay 26. This period of lockout heat is shown in FIG. 4 and provides a backup timer for the pilot ignition interval $T_3$. If the components timing the pilot ignition interval should fail, or if a flame signal does not appear, lockout relay 26 will be actuated shuting down the burner system.

When transistor 216 turns on, its emitter current flows through the burner relay 60, closing contacts 60-1 and applying power to the pilot ignition circuitry 62 and the pilot fuel valve 64.

Transistor 176 also turns on transistor 244. Collector current from transistor 244 actuates the fuel relay 52, closing contacts 52-1 across fuel valve end switch 44 in preparation for the opening of the pilot fuel valve.

The voltage drop across relay 52 also turns on transistor 252. The voltage drop across burner relay 60 and diode 232 in the emitter circuit of transistor 216 is applied to the base of transistor 256 via resistor 258. This voltage drop is sufficient to turn on transistor 256. Thus transistors 252 and 256 are both on and clamp the base of Darlington transistor 182 to ground.

Transistor 176 also turns on transistor 196 which applies power to line 202.

When the negative terminal of capacitor 134 drops below ground, diode 138 is reversed biased, disconnecting capacitor 134 from the circuit through which it charged up. Capacitor 134 now discharges through diode 201, resistors 203 and 206, and the heating element of lockout relay 26. Capacitor 134 discharges until its negative terminal is approximately 1.4 volts above ground which allows the voltage at the junction of resistor 206 and diode 208 to rise sufficiently to turn on transistor 210. The turning on of transistor 210 ends the pilot ignition interval $T_3$ and begins the main burner ignition interval.

When transistor 210 turns on, the base of Darlington transistor 216 is again clamped to ground turning off the Darlington transistor. At this point in the burner control system operation, the flame detector 282 must detect a flame, otherwise the burner control system will shut down the furnace. If a flame signal is present on line 284, this signal is applied via diodes 352, receivers 68R and 56R, resistor 354 and diode 356 to the base of transistor 358. Transistor 358 turns on providing sufficient current through burner relay 60 to keep relay 60 pulled in after transistor 216 turns off. If no flame is present in the furnace, transistor 358 is not turned on, and burner relay 60 drops out. Transistor 256 is no longer held on by either the flame signal through resistor 257, or the drop across relay 60 through resistor 258. Transistor 256 turns off removing the clamp from the base terminal of transistor 182 which continues to heat lockout relay 26 until the burner system locks out.

When transistor 210 turns on, it provides base current for transistor 270, and with line 202 held high by transistor 196, transistor 270 turns on. This turns on transistor 280. If a high flame signal is present on line 284, at this time, main fuel valve relay 290 pulls in, and the main fuel valve is open to begin the main burner ignition interval. If no flame has been established in the combustion chamber, line 284 is low, and relay 290 cannot be actuated. This prevents the main burner fuel valve 56 from opening unless there is a pilot frame. A flame signal on line 284 prior to the beginning of the flame burner ignition interval cannot actuate relay 290, since transistor 280 is off until the main burner ignition interval begins. As described above, when transistor 280 turns on, transistor 294 turns off to maintain a constant impedance across the output of flame detector circuitry 282.

When transistor 270 turns on, power is applied to line 300 and to the circuitry which times intervals $T_4$ and $T_5$. These intervals are determined by capacitors 312 and 338, as described in detail above. At the end of interval $T_4$, transistor 318 turns on actuating pilot ignition relay 240 which opens contacts 240-1 and removes power from pilot ignition circuitry 62. Shortly thereafter, transistor 332 turns on actuating relay 130. When relay 130 pulls in, contacts 130-3 open removing power from the pilot fuel valve 64 and extinguishing the pilot flame. This also opens contacts 130-1 and closes contacts 130-2, applying power to the automatic control circuitry 75 for the furnace modulator. At this point, the burner ignition sequence is complete, and the burner control system remains in its present state until operating control 38 opens or until some malfunction is detected by the burner control circuitry, shuting down the burner system.

When operating control 38 opens, optical coupler 36T is no longer illuminated and transistor 102 turns off removing power from all parts of the burner control system except those parts powered from power supply bus 100. Power is also removed from optical coupler 46T, and receiver 46R goes to a high impedance state. This interrupts base current to transistor 114 from bus 100. Transistor 114 is held on for a predetermined interval, however, by the charge stored on capacitor 131. This provides a post-operation purge period, as shown in FIG. 4. When operating control 38 opens, transistor 332 turns off removing power from automatic mode relay 130. This opens contacts 130-2 and closes contacts 130-1, applying power to low fire actuator 73. Thus, during the post purge period, the furnace modulator will move to the low fire position. The flame signal on line 284 is applied via resistor 183 to the base of Darlington transistor 182 which turns on and briefly heats the lockout relay 26 until the burner flame completely disappears.

The burner control system of the present invention shuts down the burner system if any of several different dangerous conditions are detected. If the main burner goes out during the normal firing period, the signal on line 284 from flame detector 282 goes low. The main burner fuel valve relay 290 immediately drops out closing the main fuel valve 66. Transistor 358 is no longer held on by a high signal from flame detector 282 and turns off. This removes current from burner relay 60 which also drops out. The loss of a high flame signal on line 284 removes the base current from transistor 256, unclamping the base terminal of Darlington transistor 182. Transistor 182 turns on and heats lockout relay 26 until the system goes to lockout.

If a false flame signal is detected by flame detector 282 when operating control 38 is open, the high signal on line 284 is applied via resistor 183 to the base terminal of Darlington transistor 182, turning on transistor 182. This heats the lockout relay 26 for as long as the false flame signal is present; and if this condition persists, the system goes to lockout and turns on alarm 32. A false flame signal during the purge interval similarly applies a high signal to the base of transistor 182. Transistor 252 is not turned on until the beginning of the pilot ignition interval; and thus transistor 182 turns on, heating lockout relay 26 for as long as the false flame signal appears. A high signal during the purge period on line 284 also turns on transistor 358 which provides current through burner relay 60. However, due to the resistors 364 and 366 in the collector circuit of transistor 358, the emitter current from transistor 358 is not sufficient to pull in the burner relay, although it is sufficient to hold the burner relay in an actuated position once it has been pulled in by current from transistor 216.

If a flame has not been established at the end of the pilot ignition interval, the control system shuts down the furnace operation. Transistor 216 is turned off at the end of the pilot ignition interval, and if line 284 is not high turning on transistor 358, burner relay 60 drops out. This turns off transistor 256 and Darlington transistor 182 turns on, heating lockout relay 26 until the system goes into lockout.

A switch 194 is provided to select either run or check modes for the burner control system. In run mode, the control system sequence in the normal manner and operates as described above. In check mode, the ignition and pilot valve circuits remain energized for a period of time greater than usual to allow sufficient time for performance of a pilot flame test.

With switch 194 in the check position, the circuit operation is the same as for normal operation up to the end of the pilot ignition interval $T_3$. With switch section 194A in the check position, power is not applied to the emitter of transistor 196. Thus, transistor 196 does not turn on and power is not applied to line 202. This inhibits the operation of the circuitry which times the $T_4$ and $T_5$ intervals, and relays 240 and 130 are not actuated. Transistor 280 is also prevented from turning on, preventing main fuel valve relay 290 from being actuated. In check mode, power is continuously applied via switch 194A and resistor 362 to the base of transistor 358. Transistor 358 turns on and relay 60 continues to be actuated at the end of the pilot ignition interval, even if a flame signal is not present on line 284. However, if no flame signal is present on line 284, transistor 256 turns off, and transistor 182 turns on heating lockout relay 26. This shuts down the burner system after the lockout relay delay time period, if no flame signal is present.

A second section 194B of switch 194 shuts down the system if switch 194 is moved from run to check mode during the operation of the burner control system. Switch 194B connects a large value capacitor 410 between the base of transistor 358 and ground. This turns off transistor 358 allowing burner relay 60 to drop out. Although capacitor 400 will charge back up to a voltage sufficient to allow transistor 358 to turn on again, as discussed above, the current provided by transistor 358 is insufficient to pull in burner relay 60. A resistor 412 is connected in series with capacitor 410 by switch 194 when the system is in run mode to ensure that capacitor 410 is discharged.

Typical values for the components shown in FIGS. 1–3 are given in Table 1.

There has been described a new and improved burner control system having significant advantages over previous circuits and methods known in the prior art for controlling furnace burners. It should be appreciated that modifications to the described embodiment may be made by those of ordinary skill in applying the principles of the present invention to different applications. Accordingly, the present invention should not be considered to be limited by the description herein of the preferred embodiment, but rather should be interpreted only in accordance with the following claims.

TABLE 1

| | |
|---|---|
| 26 100 Ω | 204 1 MΩ |
| 40 39 k | 206 66.5 kΩ |
| 42 1.8 k | 212 470 kΩ |
| 48 39 kΩ | 214 10 kΩ |
| 50 1.8 kΩ | 218 4.7 μF |
| 52 2.2 kΩ | 220 47 kΩ |
| 55 1.8 kΩ | 230 33 Ω |
| 57 0.01 μF | 246 10 kΩ |
| 58 22 kΩ | 248 22 kΩ |
| 60 30 Ω | 254 47 kΩ |
| 70 1085 Ω | 257 47 kΩ |
| 79 1.8 kΩ | 258 1.2 kΩ |
| 81 39 kΩ | 272 10 kΩ |
| 83 1.8 kΩ | 274 10 kΩ |
| 85 0.01 μF | 275 0.01 μF |
| 87 39 kΩ | 276 10 kΩ |
| 89 0.01 μF | 278 100 kΩ |
| 103 1.8 kΩ | 285 3.3 kΩ |
| 104 100 kΩ | 288 10 kΩ |
| 106 100 kΩ | 290 800 Ω |
| 116 24 kΩ | 298 820 Ω |
| 118 10 kΩ | 302 22.1 kΩ |
| 120 100 kΩ | 304 15 kΩ |
| 122 47 kΩ | 310 100 kΩ |
| 124 100 kΩ | 312 22 μF |
| 130 1 MΩ | 314 10 kΩ |
| 131 22 μF | 316 470 kΩ |
| 132 2.2 kΩ | 320 10 kΩ |
| 134 130 μF | 326 22.1 kΩ |
| 136 22 kΩ | 328 47 kΩ |
| 137 10 MΩ | 334 100 kΩ |
| 140 442 kΩ | 336 10 kΩ |
| 144 47 kΩ | 338 22 μF |
| 148 15 kΩ | 340 510 kΩ |
| 156 11 kΩ | 342 10 kΩ |
| 158 20 kΩ | 346 0.068 μF |
| 160 100 kΩ | 350 1.2 kΩ |

TABLE 1-continued

| | |
|---|---|
| 165 1.5 kΩ | 354 12 kΩ |
| 168 100 kΩ | 360 100 kΩ |
| 169 0.01 μF | 362 10 kΩ |
| 172 100 kΩ | 364 330 Ω |
| 174 100 kΩ | 366 330 Ω |
| 178 33 kΩ | 368 1 kΩ |
| 180 4.7 μF | 370 4.7 μF |
| 183 100 kΩ | 382 1 MΩ |
| 184 47 kΩ | 384 470 kΩ |
| 186 33 Ω | 386 100 kΩ |
| 188 33 Ω | 390 100 kΩ |
| 198 10 kΩ | 394 100 kΩ |
| 200 47 kΩ | 410 400 μF |
| 203 3 kΩ | 412 100 Ω |

What is claimed is:

1. In a furnace system including a burner, a modulator for varying the output from the burner at least between a high fire position and a low fire position, an operating control, means for igniting the burner, and blower means responsive to the modulator for providing a variable air flow through the furnace, a burner control system comprising:

means responsive to operation of said operating control for applying power to said blower means;

means responsive to operation of said operating control for applying a signal to said modulator to cause said modulator to go to the high fire position following such operation;

capacitor means;

electronic circuit means responsive to operation of the operating control for controlling charge transfer to said capacitor means for timing a purge interval of a predetermined duration following such operation, said duration corresponding to predetermined voltage change on said capacitor means;

means responsive to the timing of said purge interval for applying a signal to said modulator to cause said modulator to go to the low fire position after the end of said purge interval;

further charge transfer control means controlling charge transfer to said capacitor means for timing a second interval of a second predetermined duration which begins following the end of said purge interval; and means for igniting the burner following the end of said second interval.

2. The system of claim 1 wherein the furnace system includes a high fire switch for providing an output signal when the modulator has reached the high fire position; and wherein the purge interval timing means is responsive to the high fire switch output signal for beginning the timing of the purge interval when the modulator reaches the high fire position.

3. The system of claim 2 wherein the furnace system includes a low fire switch for providing an output indication when the modulator has reached the low fire position; and wherein the means for igniting is further responsive to the low fire switch output indication for preventing ignition of the burner until the low fire switch has indicated that the modulator has reached the low fire position.

4. The system of claim 3 wherein the furnace system includes a fuel valve end switch; and wherein the means for applying power to the blower means is further operative for preventing power from being applied to the blower means until the fuel valve end switch is closed.

5. The system of claim 4 wherein the furnace includes an air flow switch; and wherein the purge interval timing means include means for delaying the beginning of a purge interval until the air flow switch is closed.

6. The system of claim 5 wherein the burner control system further includes:

lockout means, responsive to an actuation signal applied thereto for a predetermined time for preventing further operation of the furnace system; and means responsive to the operation of the operating control for applying an actuation signal to the lockout means after operation of the operating control until the air flow switch closes.

7. The system of claim 6 wherein said electronic circuit means for timing said purge interval and said means for timing said second interval include as said capacitor means a single capacitor and means for charging said capacitor, said purge and second intervals being determined as a function of the voltage on said capacitor.

8. The system of claim 7 further including:

means for setting a first threshold;

means for setting a second threshold;

a first semiconductor, having two control electrodes which are respectively connected to the capacitor and to the first threshold means, for providing an output signal when the voltage on the capacitor reaches the first threshold;

a second semiconductor, having two control electrodes which are respectively connected to the second threshold and to the capacitor, for providing an output signal when the voltage on the capacitor reaches the second threshold; and wherein output signals from the first and second semiconductors respectively determine the end of the purge and second intervals.

9. The system of claim 8 wherein the first and second semiconductors each include a transistor, the base and emitter electrodes thereof being connected between the capacitor and the first and second threshold means respectively.

10. The system of claim 7 wherein the means for delaying the beginning of the purge interval includes:

a variable resistance element connected in series with the capacitor and having a high impedance state and a low impedance state; and means responsive to the air flow switch for causing the variable resistance element to go to a low resistance state when the air flow switch is closed.

11. The system of claim 8 wherein the means for delaying includes an optical coupler having a photo-transmitter and a photo-receiver, the photo-transmitter being connected to the air flow switch so that the photo-receiver is in a low resistance state when the switch is closed, and the photo-receiver being connected in series with the capacitor.

12. The system of claim 1 further including timing means for timing a third interval following the second interval and for actuating the means for igniting during the third interval.

13. The system of claim 12 wherein the furnace system includes means for detecting a flame in the furnace and for providing a flame signal in response to the detection of a flame, and wherein the burner control system further includes:

means for applying an actuation signal to the lockout means during the third interval; and means, responsive to the flame signal from the flame detecting means for removing the actuation signal from the lockout means at the end of the third interval when a flame is present in the furnace.

14. The system of claim 12 wherein the third interval timing means include means for discharging the capacitor at a predetermined rate to time the third interval.

15. The system of claim 12 wherein the furnace system includes means for detecting flame in the furnace and wherein the burner control system further includes means, responsive to the output signal from the flame detecting means, for applying an actuation signal to the lockout means in the absence of a flame in the furnace system at the end of the third interval.

* * * * *

UNITED STATES PATENT AND TRADEMARK OFFICE

CERTIFICATE OF CORRECTION

PATENT NO. : 4,482,312

DATED : November 13, 1984

INVENTOR(S) : Phillip J. Cade

It is certified that error appears in the above-identified patent and that said Letters Patent are hereby corrected as shown below:

Col. 4, lines 8-9: change "and fire is provided to high power switch 74" to

--and power is provided to high fire switch 74--

Col. 5, line 26: after "110," add --which--

Col. 14, l. 55: change "sequence" to --sequences--

Signed and Sealed this

*Fifth* Day of *November 1985*

[SEAL]

*Attest:*

*Attesting Officer*

DONALD J. QUIGG

*Commissioner of Patents and Trademarks*